US006666545B2

(12) United States Patent
Liu et al.

(10) Patent No.: US 6,666,545 B2
(45) Date of Patent: Dec. 23, 2003

(54) DRIVER TRANSISTOR STRUCTURE OF INKJET PRINT HEAD CHIP AND THE METHOD FOR MAKING THE SAME

(75) Inventors: Chien-Hung Liu, Taipei Hsien (TW); Jian-Chiun Liou, Kaohsiun Hsien (TW); Charles C. Chang, Hsinchu (TW); Je-Ping Hu, Hsinchu (TW); Chun-Jung Chen, Yunlin Hsien (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 10/038,909

(22) Filed: Jan. 8, 2002

(65) Prior Publication Data

US 2003/0081070 A1 May 1, 2003

(30) Foreign Application Priority Data

Oct. 26, 2001 (TW) ..... 90126507 A

(51) Int. Cl.[7] ..... B41J 2/05
(52) U.S. Cl. ..... 347/58

(58) Field of Search ..... 347/56–59, 50; 257/343

(56) References Cited

U.S. PATENT DOCUMENTS 6,102,528 A * 8/2000 Burke et al. ..... 347/59

* cited by examiner

*Primary Examiner*—Juanita Stephens
(74) *Attorney, Agent, or Firm*—Birch, Stewart, Kolasch & Birch, LLP

(57) ABSTRACT

A driver transistor structure of an inkjet print head chip and the method for making the same. Having several body contacts distributed all over the source of an active region of a large area MOSFET (Metal Oxide Semiconductor Field Effect Transistor), an equivalent $R_B$ from the MOSFET channel to the body contact is greatly diminished as the distance between them is reduced, thereby preventing the occurrence of a secondary breakdown. Since the body contact is installed inside the active region without defining in advance a body contact region and making the body contact in the field oxide layer outside the active region, about 20% of the driver transistor structure can be saved to lower the average manufacturing cost of each chip.

7 Claims, 9 Drawing Sheets

DRIVER TRANSISTOR STRUCTURE OF INKJET PRINT HEAD CHIP AND THE METHOD FOR MAKING THE SAME

BACKGROUND OF THE INVENTION

1. Field of Invention

The invention relates to a driver circuit of an inkjet print head and, more particularly, to a driver circuit-integrated driver transistor structure of an inkjet print head and the method for making the same.

2. Related Art

The inkjet printer is a common peripheral device of a computer. There is usually a print head for ejecting ink droplets in the machine, e.g. a thermal bubble inkjet print head. The basic structure of a normal print head includes an ink channel, a nozzle and an orifice plate for ejecting ink, an actuator for ink ejection and a proper driver circuit. When the inkjet printer is printing, the ink is propelled by the actuator, such as a heater, and is ejected from the nozzle on the orifice plate to form ink dots on paper. Generally speaking, the thermal bubble inkjet print head uses a heater as the actuator device, which heats up the ink in the ink channel to produce thermal bubbles to jet the ink.

In order to improve performance in terms of resolution and printing speed, one needs a large number of nozzles on each inkjet print head. Currently, the thermal bubble inkjet print head uses a design with serial driver transistors and heaters. An active driver array is incorporated in the driver circuit and is integrated into the circuit structure of the inkjet print head chip. This is the so-called IDH (integrated driver head) chip. If there are N electrical joints between the inkjet print head chip and the printer, the chip can drive and control $(N/2)^2$ nozzles. The above mentioned driver transistor is a current driver. It has to adopt a comb or grating MOSFET gate structure, or a bipolar transistor base structure to connect several sets of transistors in parallel. As shown in FIG. 1, the driver transistor structure has several MOSFET elements 21 connected in parallel. Each MOSFET element includes a source region 211, a drain region 212 and a gate 213. The gates 213 of the MOSFET elements are connected in parallel to form a comb gate structure 22. A body contact region 20' is formed outside the active region 20. The body contact region 20' is formed with a plurality of body contacts (or substrate contacts) 23. The locations and areas of the body contacts 23 can be defined by the barrier layer 24 of a polysilicon doped layer. In the prior art, the body contacts 23 and the source of the MOSFET element maintain electrical contact to maintain the substrate of the MOSFET element at the lowest level or ground. The driver transistor structure uses tetraethosiloxane ($Si(OC_2H_5)_4$, TEOS) silicon oxide, PSG, or BPSG (Boron Phosphorus Silicon Glass) as an interlayer dielectric by CVD (Chemical Vapor Deposition). The interlayer dielectric is etched to form contact holes 26 of gates, drains, sources and body contacts.

To supply a sufficient driving current, the driver transistor structure adopts the MOSFET design of a large channel W/L (Width-to-Length) ratio. The width of the active region 20 has to be between 400 micrometers and 900 micrometers to provide a working voltage of 10V and a working current above 200 mA. However, such a design makes the active region far from the body contacts (over 400 micrometers). This cannot guarantee that all channels in the MOSFET elements inside the active region are perfectly grounded, resulting in secondary breakdowns and lowering the tolerance of the elements. As to the manufacturing and structure of the driver transistor of a conventional 300 dpi or 600 dpi IDH chip, the heater, MOSFET elements, and field region with body contacts are integrated together. The body contacts are installed in the thick oxide field layer (with a thickness between 9000 A to 17500 A). In this structure, a basic body contact structure is about 15×15 $\mu m^2$, excluding the gaps in between. A MOS driver transistor structure is roughly 80×600 $\mu m^2$, excluding the body region. 18 body contacts along with the gaps in between occupy 80×150 $\mu m^2$. On the average, each driver transistor provides ⅙ to ⅓ of its area for the body contact region of the field oxide. The body contact occupies a large portion of the area.

Current products usually have 200 to 400 driver transistors on an inkjet print head. These driver transistors occupy a large portion of the area in the chip. With the increase of resolution of the inkjet print head, the number of driver transistors on a single inkjet print head chip has to be increased along with the number of heaters and nozzles. Although scaling down the MOSFET elements can accommodate more driver transistors in a unit area, the scaled-down MOSFET elements and other loops have higher parasitic resistance and the heat generated from each unit area also increases. Therefore, it requires a higher chip manufacturing cost.

Thus, how to minimize the area occupied by each driver transistor without decreasing the sizes of MOSFET elements while increasing the reliability of elements in the driver transistor structure design of an inkjet print head chip is a subject worth further research and exploration.

SUMMARY OF THE INVENTION

In view of the foregoing, an objective of the invention is to provide a driver transistor structure of an inkjet print head chip and its manufacturing method. The invention can lower the resistance $R_B$ from the MOSFET channel in the active region to the body contact, avoiding secondary breakdowns and increasing element reliability.

Another objective of the invention is to provide a driver transistor structure of an inkjet print head chip and its manufacturing method that can minimize the area occupied by each driver transistor on the inkjet print head chip without increasing parasitic resistance and manufacturing costs.

To achieve the above objectives, the invention distributes several body contacts in a large area MOSFET active region so that the equivalent resistance $R_B$ between the MOSFET channel and the body-contact greatly decreases as the distance is reduced. Therefore, it can prevent the occurrence of secondary breakdowns. Furthermore, the body contacts are installed in the active region of the driver transistor structure. For example, the body contacts are embedded in the source, the so-called BES (Body-contact Embedded in Source) structure, without defining in advance the body region and making the body contacts in the field oxide region outside the active region. Accordingly, such a BES MOSFET driver transistor structure can save about 20% area without decreasing the sizes of MOSFET elements in the active region. This method can also increase the number of inkjet print head chips on each wafer, thus lowering the average manufacturing cost of each chip.

In accordance with the disclosed driver transistor structure of an inkjet print head chip, at least one body contact is installed in an active region of the driver transistor. The active region has a plurality of MOSFET elements connected in parallel. These MOSFET's are used to control an ink actuator (e.g. current supply of a heater) in electrical contact with the driver transistor in the inkjet print head chip. The body contact can be embedded in or next to the source of the MOSFET element. The minimum distance between the dopant region of the body contact and the region of the source region with another type of dopant can be less than 5 μm. The body contact and the source of the MOSFET element in the active region are connected using a conductor to keep them at the same level.

According to the disclosed manufacturing method of the driver transistor of an inkjet print head chip, at least one body contact is installed in the active region of the driver transistor. The method forms at least one dopant barrier layer to define a dopant barrier region during the formation of the MOSFET element in the active region. The dopant barrier layer is used to prevent drain and source dopants (e.g. N+ dopants) from entering the dopant barrier region during the diffusion or ion implantation process. Afterwards, the dopant barrier layer is etched to define a dopant region for body contact. In the dopant region of body contacts, a body-contact dopant of a type opposite to the drain and source dopant is implanted in the body contact dopant region by ion implantation or diffusion to obtain the body-contact.

In particular, the dopant barrier layer can be a polysilicon layer or other materials that can stop or resist dopants, for example, a dielectric layer, refractory metal or alloy will work. The dopant barrier layer can be formed while depositing the gate polysilicon in the MOSFET element or during another deposition or coating process. Furthermore, the region of the dopant barrier layer can be defined by an etching step the same as or different from the gate polysilicon layer.

DETAILED DESCRIPTION OF THE INVENTION

Figure 1:
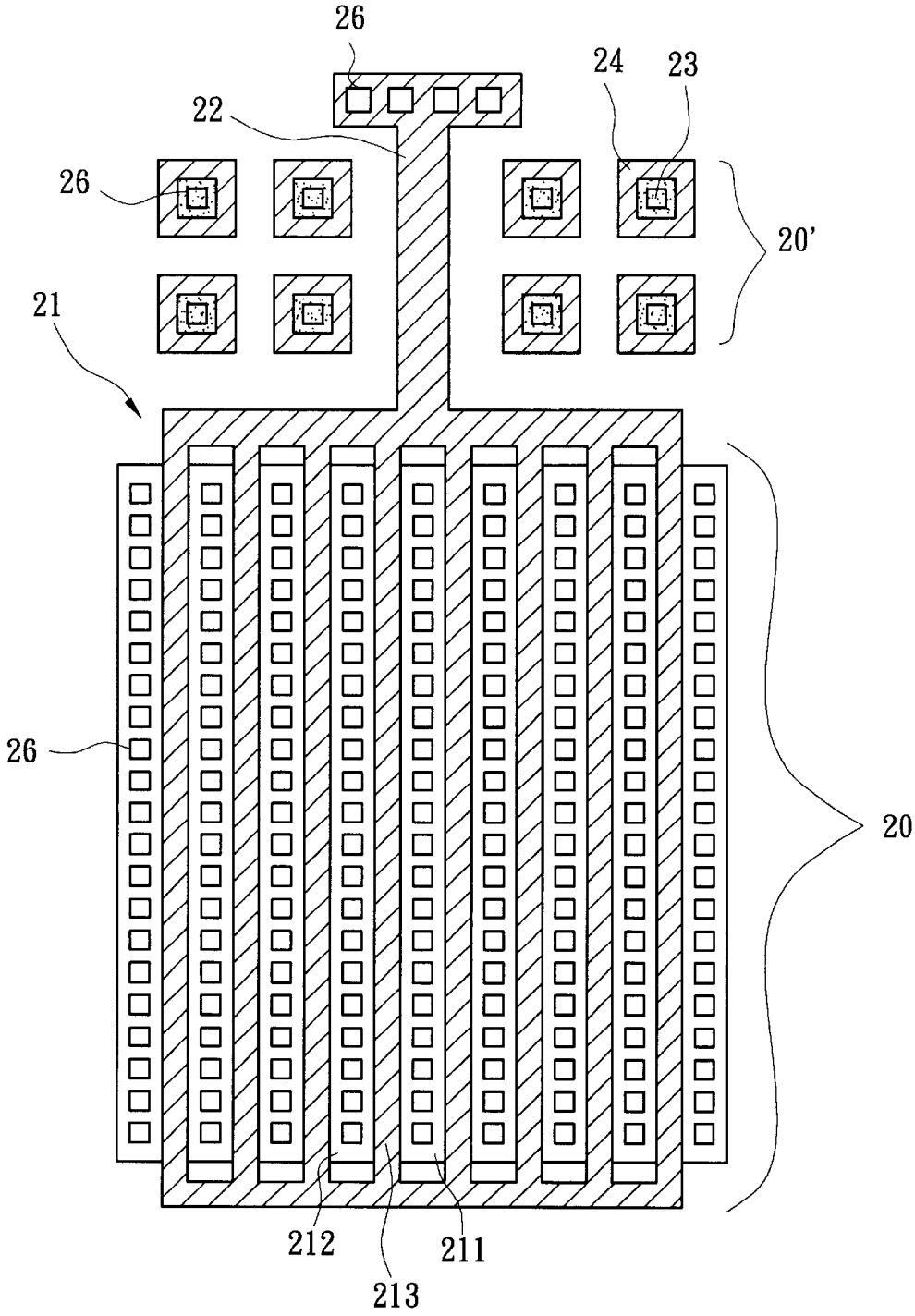
FIG. 1 BACKGROUND ART
FIG. 1 is a schematic top view of a driver transistor structure of a conventional inkjet print head chip, where a plurality of body contacts is installed in a body region outside the active region.
Figure 2A:
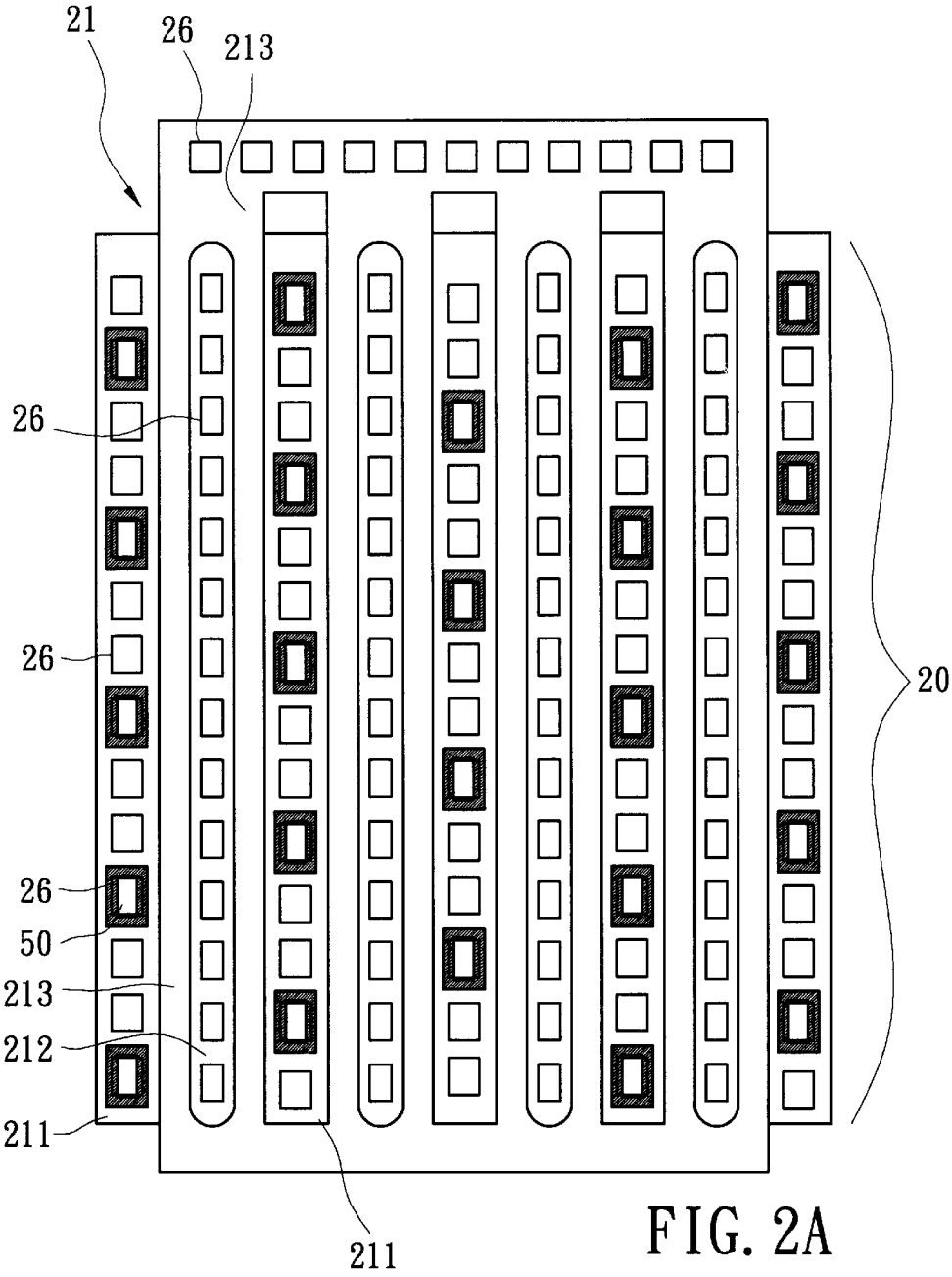
FIG. 2A is a top view of an embodiment of the driver transistor structure of the disclosed inkjet print head chip, where the body contacts are distributed in the source region of the MOSFET element in the active region.

Please refer to FIG. 2A for a BES (Body contacts Embedded in Source) driver transistor structure in an inkjet print head chip. Several body contacts 50 are installed inside the active region 20 of the driver transistor. The active region 20 has many MOSFET elements 21 connected in parallel. Each of the MOSFET elements includes a source region 211, a drain region 212 and a gate 213. The body contacts 50 are disposed in the source region 211 at a proper distance. The source regions 211, the drain regions 212, the gates 213 and the body contacts 50 are formed with appropriate contact holes 26. Each of the MOSFET elements 21 uses a large channel W/L (Width-to-Length) ratio design; that is, the channel width is far larger than the channel length. Usually, the width of the active region 20 is over 400 μm. The gate 213 can be made of polysilicon. The long gates 213 in the active region 20 are connected on both ends in parallel. Since the body contacts 50 are distributed in the source region of the active region 20, the distance and internal resistance between the body contact 50 and the MOSFET channel can be greatly reduced. All channels of the MOSFET element inside the active region 20 can be perfectly grounded, preventing secondary breakdowns. As the body contacts 50 are not necessarily installed in the field oxide region outside the active region 20, the area occupied by the driver transistor can be largely saved, which is good for minimizing the inkjet print head chip and reducing manufacturing costs.

Figure 2B:
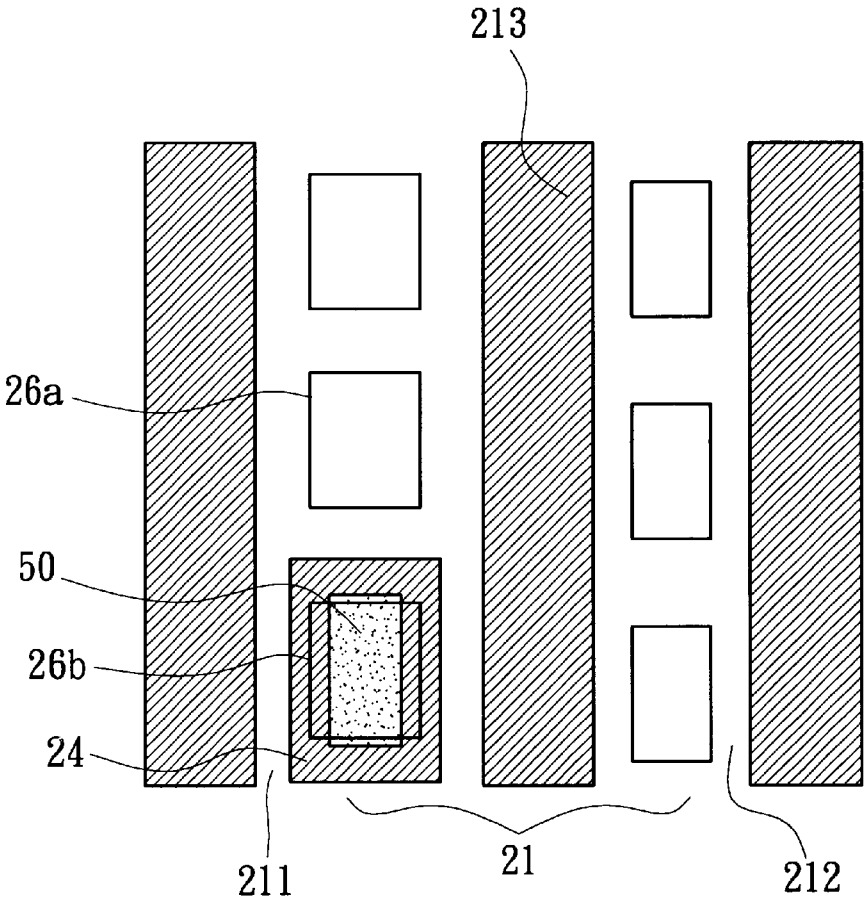
FIG. 2B is a local exploded view of FIG. 2A.

With reference to FIG. 2B, the location and shape of the body contacts 50 are defined by a dopant barrier layer 24 formed on the source region 211. In other words, the dopant barrier layer 24 can be a polysilicon layer formed in the same deposition step for forming the gate 213. Its region can also be defined in the same etching step as the gate 213. The source contact hole 26*a* and the body contact hole 26*b* in the source region 212 can be separately designed as shown in the drawing.

Figure 3A:
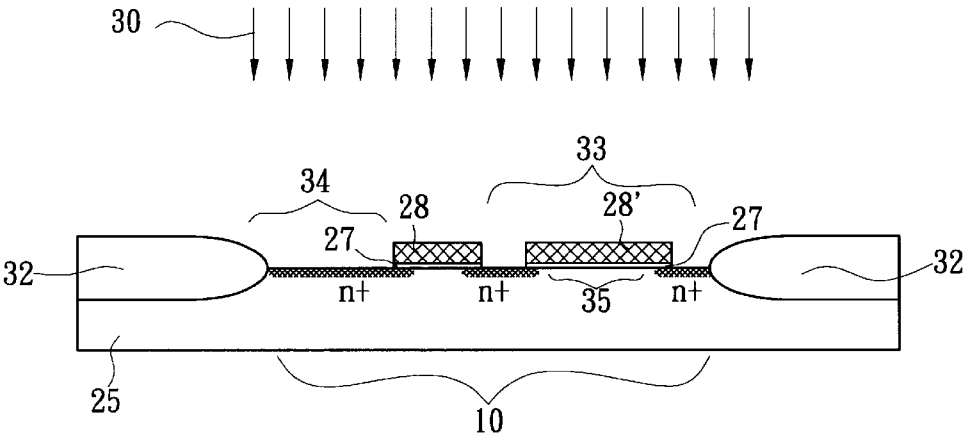
FIGS. 3A through 3D show cross-sectional views of the procedure in an embodiment of the manufacturing method for a driver transistor of the inkjet print head chip.

Please refer to FIGS. 3A through 3D. As shown in FIG. 3A, an active region 10 is defined on the surface of a substrate 25 by silicon oxide and silicon nitride. The LOCOS procedure is further used to grow a thick field oxide layer 32 outside the active region 10. The substrate 25 in this embodiment is a p-type Si substrate and the thickness of the LOCOS field oxide layer 32 is between 8000 A and 18000 A. Afterwards, the silicon oxide and silicon nitride are removed and a gate insulator 27 is grown by dry oxidation, or the silicon oxide and silicon nitride can be directly used as the gate insulator 27 by removing the silicon oxide and silicon nitride on the source region 33 and the drain source 34 only. Afterwards, a polysilicon layer is formed on the gate insulator 27 by CVD. It is preferable to define the gate polysilicon layer 28 and the body-contact dopant barrier layer 28' inside the active region by photolithography and polysilicon etching. The dopant barrier layer 28' occupies some area in the source region 33, forming a dopant barrier region 35 in the source region. The dopant barrier layer 28' is used as a barrier layer again the diffusing or implanting n+ dopants (e.g. P or As) for the source region 33 and the drain region 34. This ensures that the region for body-contact 35 in the source region is not implanted by n+ dopants. In the current embodiment, though the dopant barrier layer 28' is made of a polysilicon layer, the invention is not limited to this. The dopant barrier layer can be made of other materials for blocking dopants. The dopant barrier layer can be formed in the same deposition step as the gate polysilicon or in another deposition or coating process. In addition, the region of the dopant barrier layer can be defined in the same or in a different etching step for the gate polysilicon layer 28.

Figure 3B:
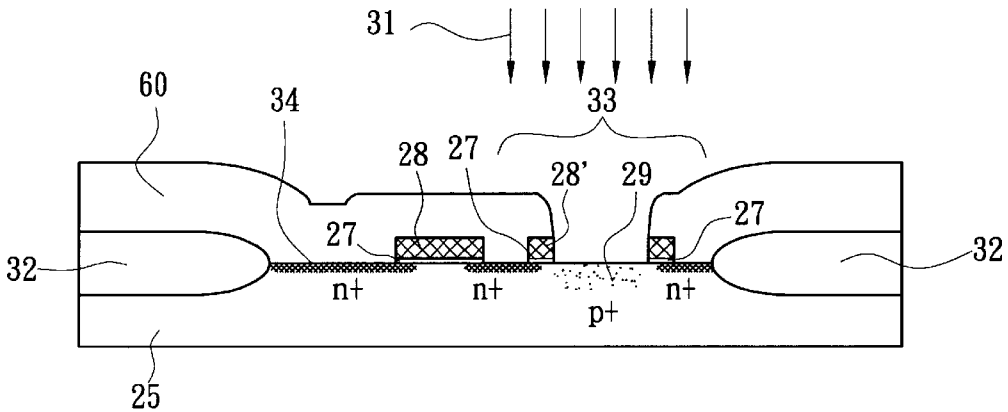

With reference to FIG. 3B, photolithography and etching procedures are performed to define the region of a body contact dopant 29 by developing on a photo resist layer and etching polysilicon. The body contact dopant region 29 is doped with p+ dopants, such as boron dopants, by ion implantation or diffusion 31.

Figure 3C:
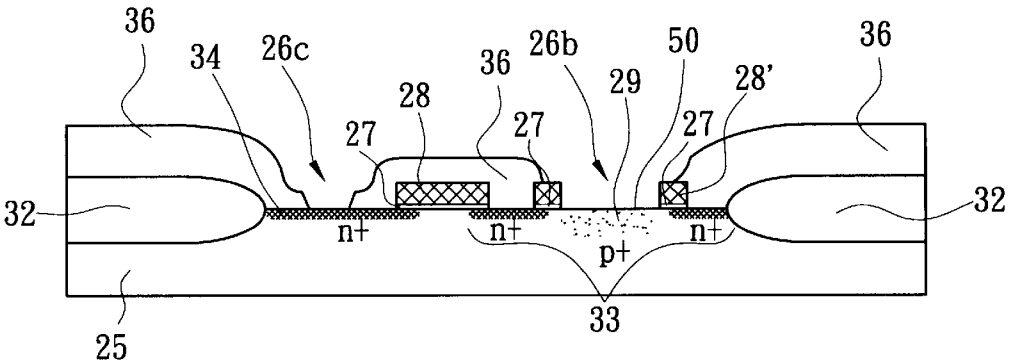

As shown in FIG. 3C, remove the photo resist layer 60 tetraethosiloxane ($Si(OC_2H_5)_4$, TEOS) silicon oxide, PSG, or BPSG as an interlayer dielectric 36 of the driver transistor by CVD (Chemical Vapor Deposition). Reflow is employed to improve the topographical smoothness. Lithography and etching are used again to open appropriate electrode contact holes on the interlayer dielectric 36, including the gate, source contact holes (not shown in the drawing), drain contact holes 26*c* and body contact holes 26*b*. A body contact 50 can be obtained in the source region 33. The distance between the dopant region of the body contact and the source region with the other type of dopant can be less than 5 $\mu$m.

Figure 3D:
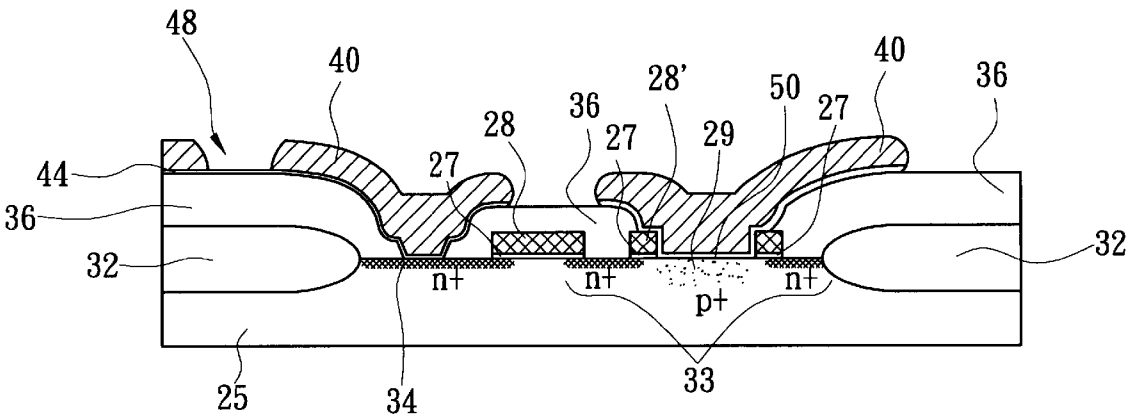

As shown in FIG. 3D, a heater layer 44 and a conductive layer 40 are formed on the interlayer dielectric 36 and the electrode contact holes 26*b*, 26*c* by sputtering or evaporation. The heater layer 44 and the conductive layer 40 can be also defined by lithography and etching, thereby forming a heater 48 and a wire connecting the drain region 34 and the heater 48. At the same time, a metal conductor connecting the body contact 50 and the source region 33 is defined. The driver transistor structure of the inkjet print head chip in the embodiment is thus completed.

Figure 2C:
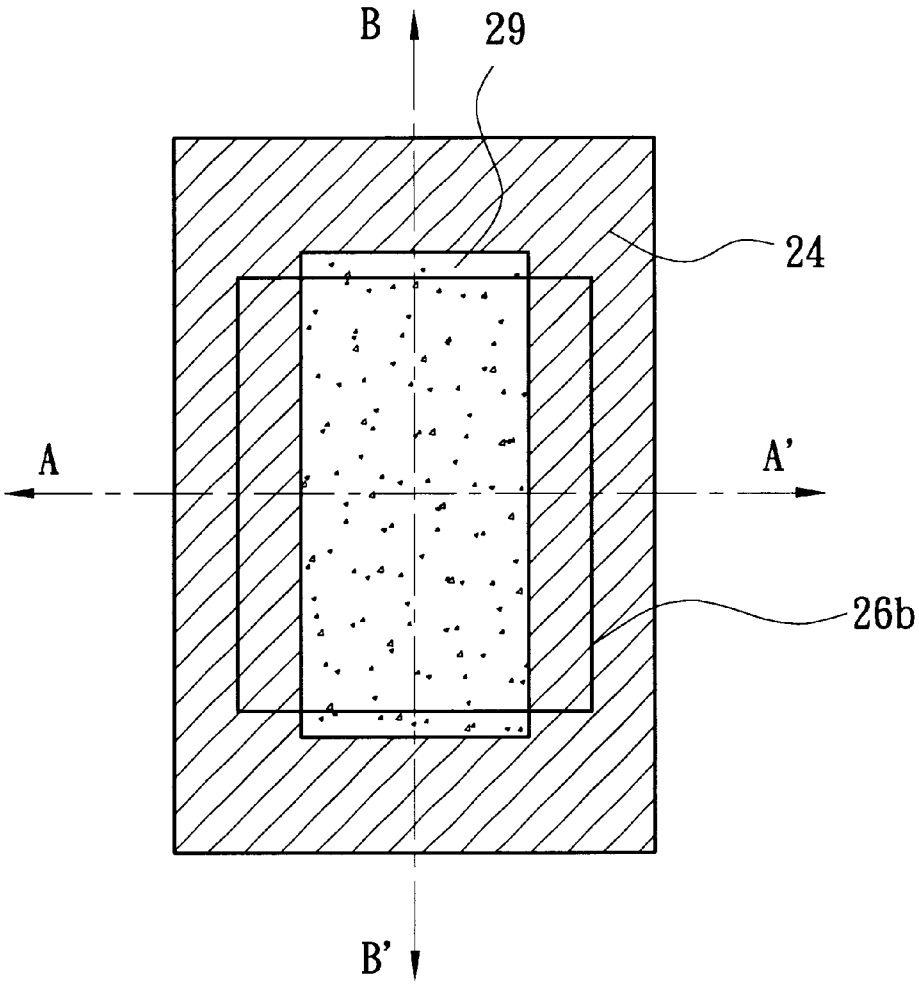
FIG. 2C is an exploded top view of a body contact structure.

The size of the body contact hole 26*b* in the above-mentioned embodiment is larger than the body-contact dopant region. As shown in FIG. 2C, the size of the body contact hole 26*b* in the AA' direction is greater than the body-contact dopant region 29 but smaller than the region of the dopant barrier layer 24.

Figure 3E:
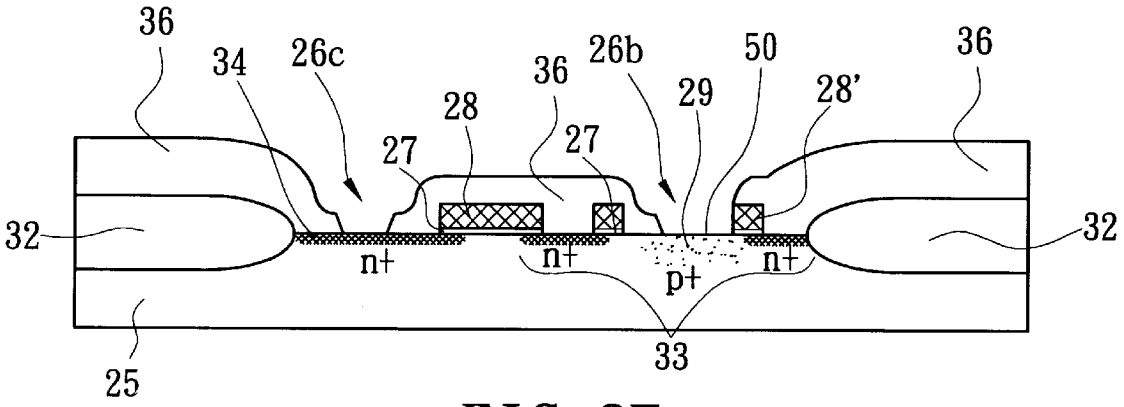
FIGS. 3E through 3F show another embodiment of the manufacturing method for a driver transistor of the inkjet print head chip, where the size of the body contact holes is smaller than the body dopant region.
Figure 3F:
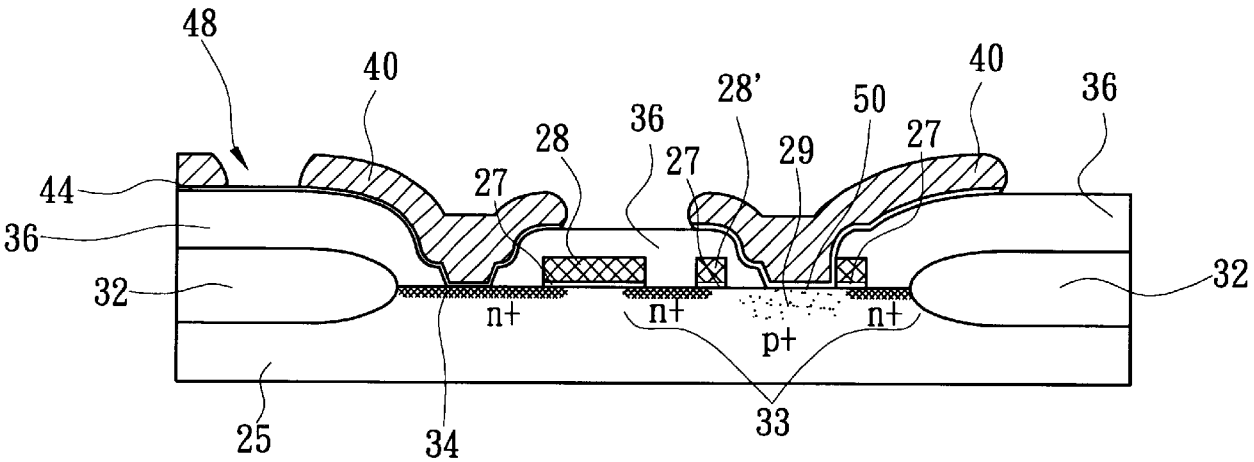

The size of the body contact hole 26*b* can be smaller than the body contact dopant region 29. As shown in the drawing, the size of the body contact hole 26*b* in the BB' direction is not larger than the body contact dopant region 29. The interlayer dielectric 36 corresponding to the body contact dopant region 29 can open smaller contact holes 26*b* using the method illustrated in FIGS. 3E through 3F, followed by the procedure of forming the heater layer 44 and the conductive layer 40. The body contact hole and the source contact hole use the design of shared contact holes.

Figure 4A:
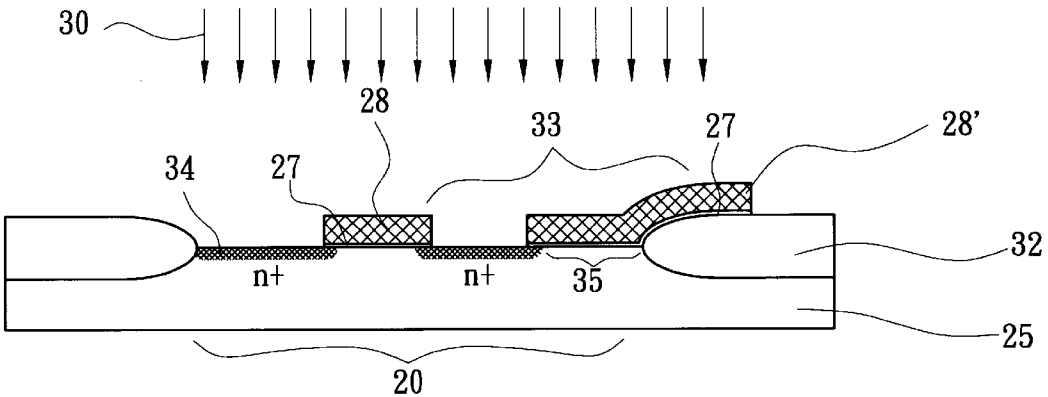
FIGS. 4A through 4D show cross-sectional views of the procedure in yet another embodiment of the manufacturing method for a driver transistor of the inkjet print head chip, where the dopant barrier layer extends to the field oxide to make the body contact close to the source.

FIGS. 4A through 4D show another embodiment for making the driver transistor. With reference to FIG. 4A, an active region 20 is defined on a substrate surface 25 in the same way as the previous embodiment and a thick field oxide layer 32 is grown outside the active region 20 using the LOCOS procedure. The substrate 25 is a p-type Si substrate and the thickness of the LOCOS field oxide layer is between 8000 A and 18000 A. Afterwards, a gate insulator 27 is formed and a polysilicon layer is formed by CVD. It is preferable to define the gate polysilicon layer 28 and the dopant barrier layer 28' inside the active region by photolithography and polysilicon etching. The dopant barrier layer 28' occupies some area in the source region 33, forming a dopant barrier region 35 in the source region. The dopant barrier layer 28' can extend to the field oxide layer adjacent to the source region 33. The dopant barrier layer 28' is used as a barrier layer against diffusing or implanting n+ dopants (e.g. P or As) for the source region 33 and the drain region 34. This ensures that the region for body-contact 35 in the source region is not implanted with n+ dopants. The dopant barrier layer 28' can be made of a polysilicon layer or any other material that stops or resists dopants. The dopant barrier layer can be formed in the same deposition step as the gate polysilicon or in a different deposition or coating step. In addition, the dopant barrier layer can be defined in the same or in a different etching step for the gate polysilicon layer 28.

Figure 4B:
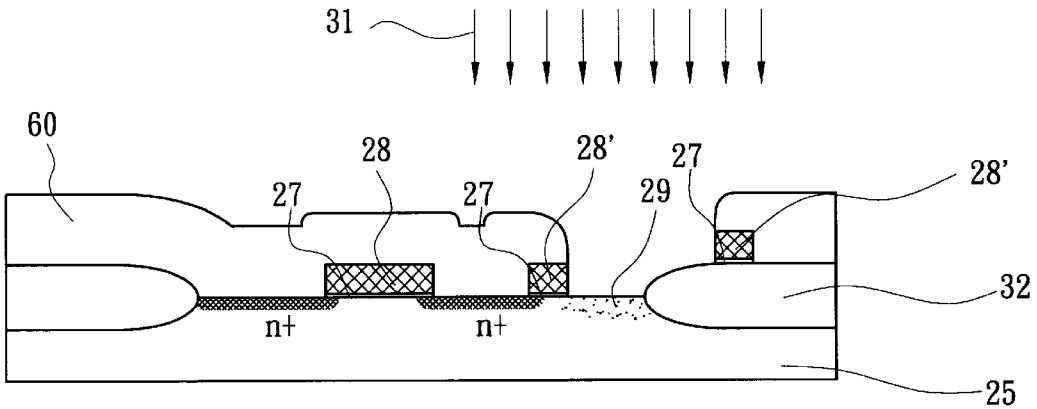

With reference to FIG. 4B, photolithography and etching procedures are performed to define the body contact dopant region 29 by developing on a photo resist layer 60 and etching polysilicon. The body contact dopant region 29 is doped with p+ dopants, such as boron dopants, by ion implantation or diffusion 31.

Figure 4C:
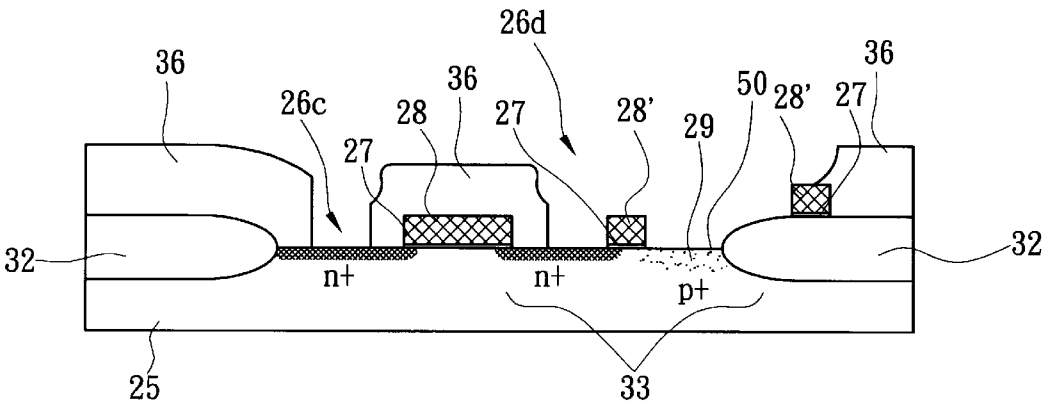

As shown in FIG. 4C, remove the photo resist layer 60, and then deposit a layer of the tetraethosiloxane ($Si(OC_2H_5)_4$, TEOS) silicon oxide, PSG, or BPSG as an interlayer dielectric 36 of the driver transistor by CVD (Chemical Vapor Deposition). Reflow is employed to improve the topographical smoothness. Lithography and etching are used again to open appropriate electrode contact holes on the interlayer dielectric 36, including the gate, source contact holes (not shown in the drawing), drain contact holes 26*c* and body contact holes 26*d*. A body contact 50 can be obtained in the source region 33. The distance between the dopant region of the body contact and the source region with another type of dopant can be less than 5 $\mu$m.

Figure 4D:
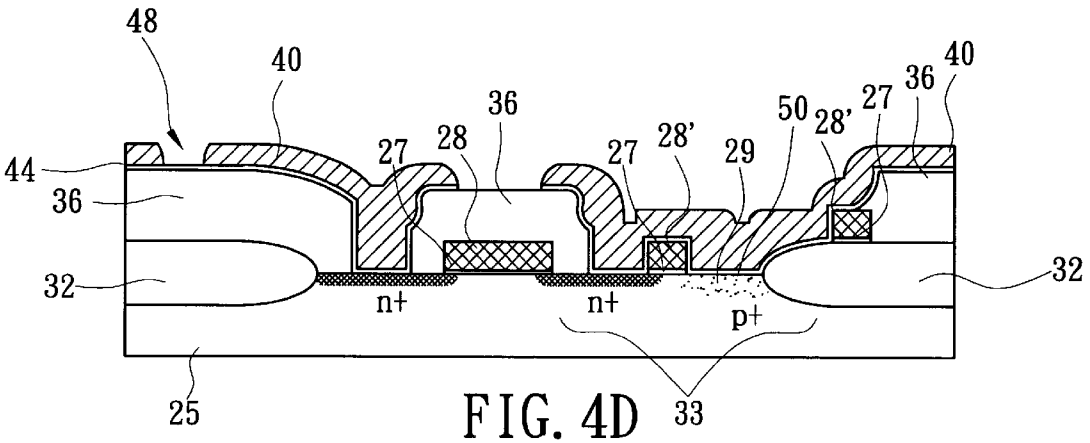

As shown in FIG. 4D, a heater layer 44 and a conductive layer 40 are formed on the interlayer dielectric 36 and the electrode contact holes 26*c*, 26*d* by sputtering or evaporation. The heater layer 44 and the conductive layer 40 can also be defined by lithography and etching, thereby forming a heater 48 and a wire connecting the drain region 34 and the heater 48. At the same time, a metal conductor connecting the body contact 50 and the source region 33 is defined. The driver transistor structure of the inkjet print head chip in the embodiment is thus completed.

Although the invention has been described with reference to specific embodiments, this description is not meant to be construed in a limiting sense. Various modifications of the disclosed embodiments, as well as alternative embodiments, will be apparent to persons skilled in the art. It is, therefore, intended that the appended claims will cover all modifications that fall within the true scope of the invention.

What is claimed is:

1. A driver transistor structure of an inkjet print head chip, which comprises an active region for a plurality of MOSFET (Metal Oxide Semiconductor Field Effect Transistor) elements to control electrical current supply of an ink actuator in electrical connection with the driver transistor inside the inkjet print head chip, the driver transistor structure of the inkjet print head chip being characterized in that: at least one body contact is installed in the active region and in electrical connection with the source of the MOSFET element for keeping them at an equal voltage level.

2. The driver transistor structure of claim 1, wherein the at least one body contact is installed in the source region of the MOSFET element in the active region.

3. The driver transistor structure of claim 1, wherein the at least one body contact is installed close to the source region of the MOSFET element in the active region.

4. The driver transistor structure of claim 1, wherein the at least one body contact extends to the boundary of a field oxide region adjacent to the active region.

5. The driver transistor structure of claim 1, wherein a distance between a dopant region for the body contact and the source region with the other dopant type is not over 5 micrometers.

6. The driver transistor structure of claim 1, wherein the actuator is a heater that generates thermal bubbles to push ink.

7. The driver transistor structure of claim 1, wherein the resistance $R_B$ from the MOSFET channel in the active region to the body contact is lower to avoid secondary breakdown and to increase reliability.

* * * * *